US007416671B2

(12) United States Patent
Bozak et al.

(10) Patent No.: US 7,416,671 B2
(45) **Date of Patent: *Aug. 26, 2008**

(54) SEPARATION AND RECOVERY OF BITUMEN OIL FROM TAR SANDS

(75) Inventors: Wade Ralph Bozak, Edmonton (CA); Roderick Michael Facey, Edmonton (CA)

(73) Assignee: RJ Oil Sands Inc., New Westminster (CA)

( * ) Notice: Subject to any disclaimer, the term of this patent is extended or adjusted under 35 U.S.C. 154(b) by 214 days.

This patent is subject to a terminal disclaimer.

(21) Appl. No.: 10/895,364

(22) Filed: Jul. 21, 2004

(65) Prior Publication Data

US 2006/0016760 A1 Jan. 26, 2006

(51) Int. Cl.
*B01D 17/038* (2006.01)

(52) U.S. Cl. ..... 210/708; 208/391; 208/425; 210/710; 210/737; 210/738; 210/770; 210/787

(58) Field of Classification Search ..... 210/708
See application file for complete search history.

(56) References Cited

U.S. PATENT DOCUMENTS 3,764,008 A * 10/1973 Darley et al. ..... 210/704
3,925,189 A 12/1975 Wicks
4,229,295 A * 10/1980 Krofchak ..... 210/723
4,414,117 A * 11/1983 Yong et al. ..... 210/710
4,424,112 A 1/1984 Rendall
4,425,227 A * 1/1984 Smith ..... 209/5
4,451,184 A 5/1984 Mitchell
4,519,899 A 5/1985 Oertle et al.
5,012,984 A 5/1991 Ishikawa
5,110,457 A 5/1992 Krawl et al.
5,460,270 A 10/1995 Chan et al.
5,879,541 A 3/1999 Parkinson
5,935,447 A 8/1999 Febres et al.
6,004,455 A 12/1999 Rendall
6,074,549 A * 6/2000 Bacon Cochrane et al. . 208/391

(Continued)

FOREIGN PATENT DOCUMENTS

CA 2159514 A1 3/1997

(Continued)

OTHER PUBLICATIONS

Information sheet from Genflo titled "Jet Pumps"; www.genflopumps.com/scrubbing.html p. 1-2, at least as early as Mar. 2004.

(Continued)

*Primary Examiner*—Peter A. Hruskoci
(74) *Attorney, Agent, or Firm*—Christensen O'Connor Johnson Kindness PLLC

(57) ABSTRACT

A process for the separation of bitumen oil from tar sands and the like. Slurry is supplied to a mixing chamber of a jet pump at an input end of the process. The slurry is agitated within the jet pump to effect a partial to full phase separation of the oil fraction from the solids fraction of the slurry. The partially to fully separated slurry is discharged into a pipeline and later into a hydrocyclone to effect a second phase separation of the slurry. One or more hydrocyclone separators may be used to separate the bitumen oil and liquid from the solids fraction.

6 Claims, 9 Drawing Sheets

U.S. PATENT DOCUMENTS

| | | | | |
|---|---|---|---|---|
| 6,106,733 | A * | 8/2000 | Wood | 210/774 |
| 6,162,021 | A | 12/2000 | Sarshar | |
| 6,527,960 | B1 | 3/2003 | Bacon et al. | |
| 6,821,060 | B2 * | 11/2004 | McTurk et al. | 406/137 |
| 2007/0131590 | A1 | 6/2007 | Bozak | |
| 2007/0181158 | A1 | 8/2007 | Bozak | |

FOREIGN PATENT DOCUMENTS

| | | |
|---|---|---|
| CA | 2229970 | 5/1999 |
| CA | 2319566 | 8/1999 |
| CA | 2420034 A1 | 8/2004 |
| CA | 2453697 A1 | 6/2005 |

OTHER PUBLICATIONS

Information sheet from Vortex Ventures Inc. titled "Spintop Hydrocyclone"; www.vortexventures.com; p. 1-5; at least as early as Mar. 2004.

Information sheet from Vortex Ventures Inc. titled "Lobestar Mixing Eductor For Liquid and Slurry Applications"; www.vortexventures.com p. 1-3; at least as early as Mar. 2004.

* cited by examiner

SEPARATION AND RECOVERY OF BITUMEN OIL FROM TAR SANDS

BACKGROUND OF THE INVENTION

This invention relates to a method for separating bitumen oil from tar sands and the like.

The current industry practice for extracting bitumen from tar sands and the like is the hot water process, utilizing aggressive thermal and mechanical action to liberate and separate the bitumen. The hot water process is typically a three-step process. Step one involves conditioning the oil sands by vigorously mixing it with hot water at about 95 degrees Celsius and steam in a conditioning vessel to completely disintegrate the oil sands. Step two is the gravity separation of the sand and rock from the slurry, allowing the bitumen to float to the top where it is concentrated and removed as a bitumen froth. Step three is treatment of the remainder slurry, referred to as the middlings, using froth floatation techniques to recover bitumen that did not float during step two. To assist in the recovery of bitumen during step one, sodium hydroxide, referred to as caustic, is added to the slurry in order to maintain the pH balance of the slurry slightly basic, in the range of 8.0 to 8.5. This has the effect of dispersing the clay, to reduce the viscosity of the slurry, thereby reducing the particle size of the clay minerals.

A problem related to the industry practice is that the addition of caustic, coupled with the vigorous and complete physical dispersal of the fines, produces a middlings stream that may contain large amounts of well dispersed fines held in suspension. The recovery of bitumen from these middlings stream increases with the increase in the fines concentration over time. In addition, the middling stream that remains following step three, referred to as the scavenging step, poses a huge disposal problem. Current practice for the disposal of the resultant sludge involves the pumping of the sludge into large tailings ponds. This practice poses serious environmental risks.

The industry practice for the extraction of bitumen from oil sands has been to maximize the recovery of bitumen while minimizing the production of sludge, which require treatment and disposal. The industry practice typically provides for a bitumen recovery of between about 80% and 95% of the total amount of bitumen contained in the oil sands. Lower bitumen recoveries are experienced with oil sands of high fine material and low bitumen contents. To increase bitumen recovery, methods have arisen to reheat and recycle water recovered during the solids de-watering phase to re-expose the suspension of dispersed fine material to the conditioning bath, whereby the dispersed fine material may undergo further froth floatation treatment for bitumen recovery.

SUMMARY OF INVENTION

A process for the separation of bitumen oil from tar sands and the like is disclosed. Slurry is supplied to a mixing chamber of a jet pump at an input point of the separation process. The slurry is agitated within the jet pump and pipeline to effect a partial to full phase separation of the oil and water fraction from the solids fraction of the slurry. The partially to fully separated fractions of the slurry is discharged into a hydrocyclone to effect a second phase separation of the slurry. One or more hydrocyclone separators may be used to separate and concentrate any remaining residual bitumen oil and liquid from the solids fraction.

The process distinguishes itself from others in that it does not contemplate the use of elutriation vessels, clarifiers, separators, baths or similar devices to condition and/or to separate the oil and liquids from the solids fraction. An aspect of the invention is that bitumen separation is achieved during mixing within the jet pump and within the pipeline. The extraction of bitumen oil from the tar sands and the release of the solid particles from the oil sand matrix continues in the slurry exiting the jet pump as the jet pump transports the slurry to the material separation and classification process.

Pre-conditioning of the raw material is not a requirement of this process, greatly reducing the infrastructure of the plant. Rather the solids fraction of the slurry is physically and/or chemically conditioned by the wash fluid that can consist of a cold or hot water, or a solvent or a water chemically treated or a mixture of all. The use of elutriation vessels, clarifiers, separators, baths or the like are replaced with hydrocyclone separators. The hydrocyclone separators are designed to separate and classify the slurry stream using centrifugal forces into two stream fractions consisting of water and oil and solids. The process can be applied to separate bitumen attached to any type of solid. Further, multiple wash step loops are possible to maximise bitumen separation and recover, or to achieve any level of treatment recovery desired.

An apparatus according to an aspect of the invention comprises hopper, motive pump, jet pump, pipeline, and hydrocyclone separator. The hopper is designed to receive the raw material and can be shaped as a cone bottom vessel or alternatively equipped with a mechanical auger designed to convey material to the inlet of the jet pump. The motive pump is designed to supply the high pressure fluid necessary to operate the jet pump which by use of a nozzle within the jet pump the fluid is converted into a high velocity jet to produce a vacuum within the mixing chamber of the jet pump to suction the tar sands into the inlet of the jet pump. Further aspects of the invention are described in the detailed description that follows.

BRIEF DESCRIPTION OF THE DRAWINGS

An exemplary embodiment is now described in detail with reference to the drawings, in which:

FIGS. 1A-1G are flow charts of a process of separation and recovery of bitumen from tar sands in which the proposed invention may be used, in which FIG. 1A shows a first wash treatment process of the input slurry with water, FIG. 1B shows wash steps with solvent on the heavier output from the steps of FIG. 1A, FIG. 1C shows wash steps with water on the heavier output from FIG. 1B, FIG. 1D shows a first oil\water separation treatment process on the lighter output from the process of FIG. 1A, FIG. 1E shows process steps for the treatment of de-watered solids using a thermal screw, FIG. 1F shows treatment of recovered wash water and FIG. 1G shows the interrelationship of FIGS. 1A-1F;

FIG. 2 is a schematic of the feed hopper, jet pump, pipeline and hydrocyclone according to the invention; and.

With reference to FIGS. 1A-1G, an overview of a process for the separation and recovery of bitumen oil from tar sands and the like is described. Tar sands, also referred to as oil sands, are a matrix of bitumen, water, and mineral material. The bitumen consists of viscous hydrocarbons, which acts as a binder for the other components of the oil sand matrix. A typical deposit of oil sand will contain about 10% to 12% bitumen and about 3% to 6% water. The mineral material consists of rock, sand, silt and clay. Clay and silt are considered to be fines. Mineral material can contain about 14% to 30% fines. Although it is understood that the described process and apparatus may be applied to removing oil from any type of particulate material, in accordance with a preferred embodiment of the invention, the process and apparatus are applied to separating and recovering bitumen oil from tar sands, such as that derived from mining or drilling operations.

As shown in FIG. 1A, unprocessed tar sands or tailings 1 from a mining or drilling operation may be fed into a receiving hopper 2 via preferably a belt conveyor 3 or alternatively via a front end loader 4 at an input end of the tar sands separation process. At the input end, the unprocessed tar sands have undergone little or no processing, and no phase separation. The belt conveyor 3 features a troughed belt on 20 degree or greater idlers and are readily available in the industry. The receiving hopper 2 may be supplied with a mechanical grinder 5 and has its discharge coupled to a jet transfer pump 6. The mechanical grinder 5 is also readily available in the industry. The jet pumps 6 is also readily available in the industry, such as those manufactured by Genflo Pumps, but some care must be taken in choosing the jet pump, and it is preferred to use the jet pump shown in FIG. 3. The jet pump 6 should operate at a high Reynolds number, above 250,000, and preferably in the order of 650,000 to 750,000. Such a Reynolds number may be obtained by a combination of high pressure, for example 80 psi or more, and a sufficiently long mixing chamber, as for example shown in FIG. 3. All jet pumps described in this patent document preferably have this configuration.

Figure 1A:
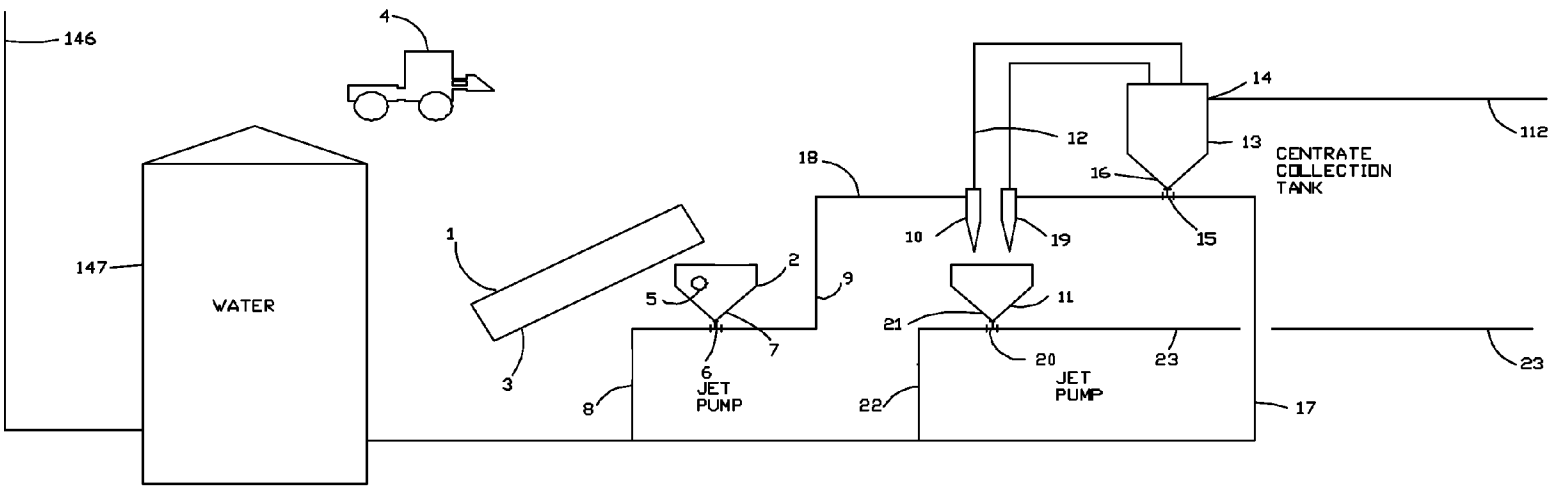

As the tar sands enter the receiving hopper 2 they may be mechanically ground, preferably using a mechanical grinder 5 to produce particles 50 mm in size or smaller. The jet transfer pump 6 at the respective base of cone 7 of the receiving hopper 2 mixes the ground tar sands 1 with a hot water stream from line 8 to produce a hot slurry mixture in line 9 which is passed into a first hydrocyclone separator 10. Centrifugal forces within the first hydrocyclone separator 10 separate a large portion of the solids from the bitumen oil and water mixture. The solids are removed from the bottom of hydrocyclone separator 10 and gravity discharged into cone bottom hopper 11. The remaining slurry mixture, comprising primarily of the bitumen oil and water, in line 12, is gravity discharged into a centrate collection tank 13. Any residual solids in this stream settle to the bottom of the centrate collection tank 13. The oil and water are removed from the top at point 14 of the centrate collection tank. A further jet transfer pump 15 located at base 16 of the centrate collection tank 13 removes and mixes the solids with the hot water stream in line 17 and passes it through line 18 to a second hydrocyclone separator 19. Centrifugal forces within the second hydrocyclone separator 19 separate the remaining portion of the solids from the oil and water fractions. The solids are removed from the bottom of hydrocyclone separator 19 and gravity discharged into the cone bottom hopper. A jet transfer pump 20 located at base 21 of the cone bottom hopper 11 removes and mixes the solids with the hot water stream in line 22 and passes it through line 23 to the inlet of centrifuge 24. Optionally, the water wash step can be repeated multiple times with each step identical to the preceding step.

Figure 1B:
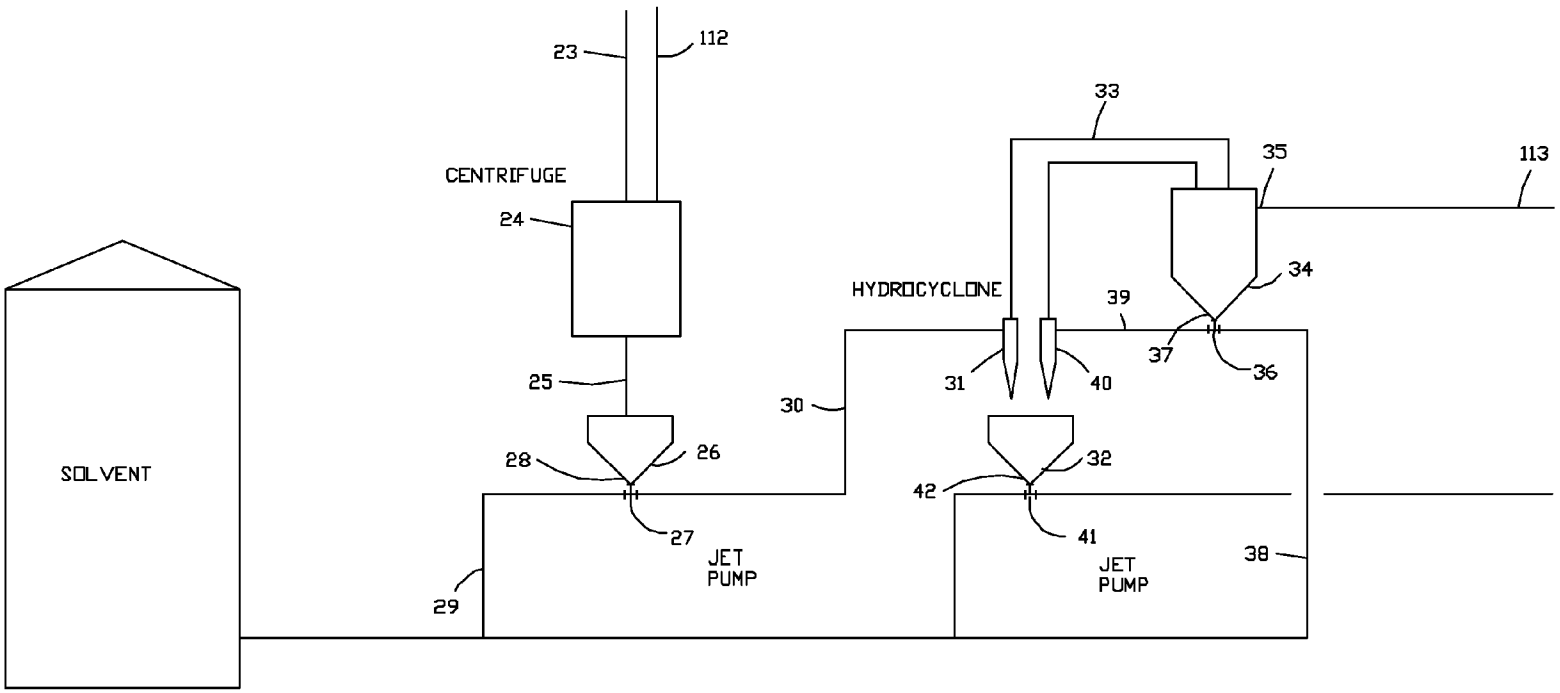

As shown in FIG. 1B, solids removed from the bottom of the cone bottom hopper 11 are de-watered using centrifuge 24, preferably a basket or solid bowel centrifuge. Alternative mechanical dewatering technology such as inclined dewatering screws or belt filter presses can also be used. De-watered solids 25 are discharged into a cone bottom receiving hopper 26. A jet transfer pump 27 at the base of the cone 28 of the receiving hopper 26 mixes the solids with the heated solvent stream from line 29 to produce the heated slurry mixture in line 30 which is passed into the first hydrocyclone separator 31. Centrifugal forces within the first hydrocyclone separator 31 separate a large portion of the solids from the oil and solvent mixture. The solids are removed from the bottom of hydrocyclone separator 31 and gravity discharged into the cone bottom hopper 32. The remaining slurry mixture, comprised primarily of the oil and solvent, in line 33, is gravity discharged into the centrate collection tank 34. Any residual solids in this stream settle to the bottom of the centrate collection tank 34. The oil and solvent are separated from the top of centrate collection tank at point 35. The jet transfer pump 36 located at the respective base 37 of the centrate collection tank 35 mixes the solids with the heated solvent stream in line 38 and passes it through line 39 to the second hydrocyclone separator 40. Centrifugal forces within the second hydrocyclone separator 40 separates the remaining portion of the solids from the oil and solvent mixture. The solids are removed from the bottom of hydrocyclone separator 40 and gravity discharged into the cone bottom hopper 32. Optionally, the solvent wash step can be repeated multiple times with each step identical to the preceding step.

Figure 1C:
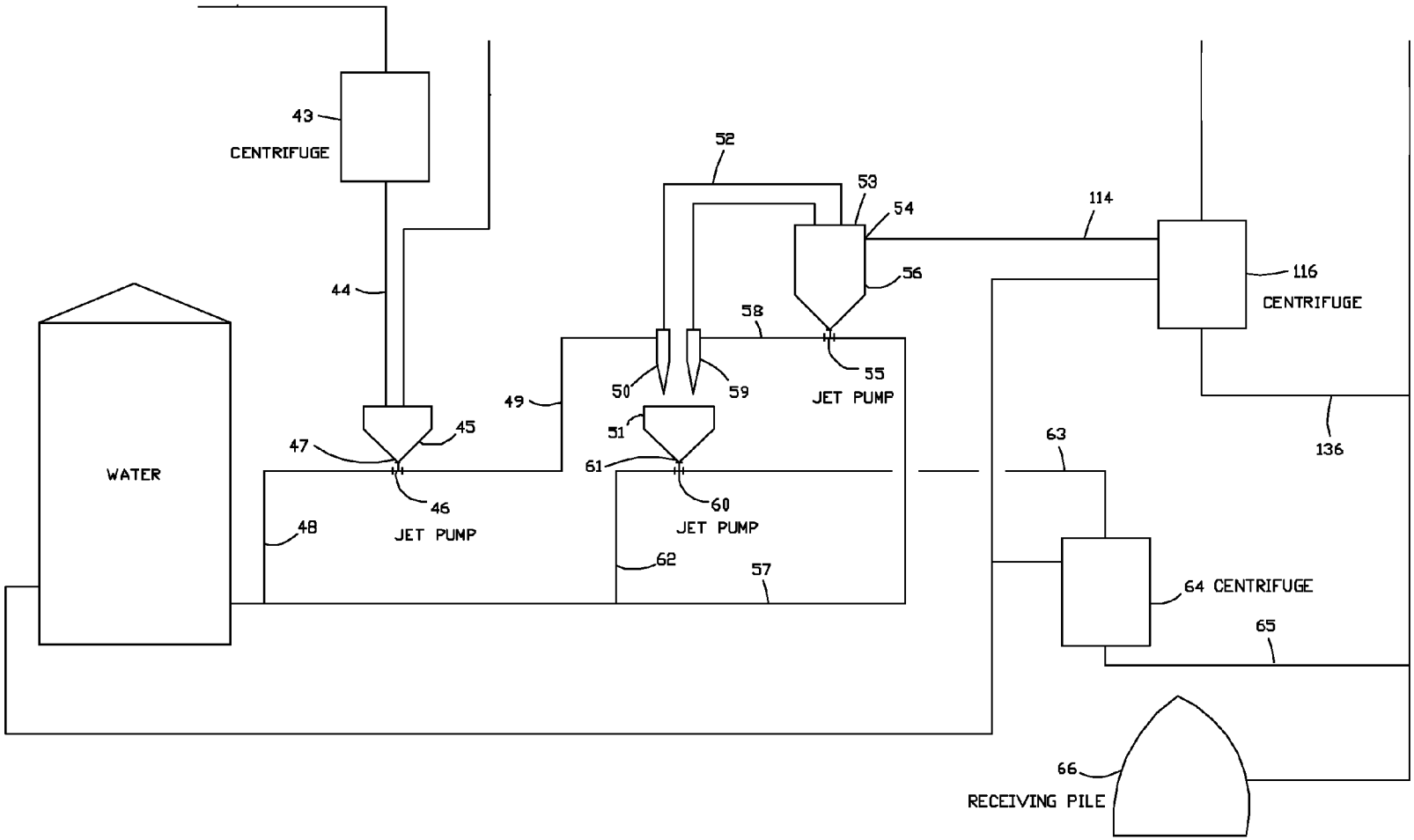

Referring to FIGS. 1B and 1C, solids that are deposited in cone bottom hopper 32 are removed via jet pump 41 at base 42 and de-watered by centrifuge 43, preferably using a basket or solid bowel centrifuge. Other alternative mechanical dewatering technology can be used such as inclined dewatering screws and or belt filter presses. De-watered solids 44 are gravity discharged into a cone bottom receiving hopper 45. Jet transfer pump 46 at the base of the cone 47 of the receiving hopper 45 mixes the de-watered solids with the hot water stream from line 48 to produce the hot slurry mixture in line 49 which is passed into a hydrocyclone separator 50. Centrifugal forces within the first hydrocyclone separator 50 separate a large portion of the solids from the oil and water mixture. The solids are removed from the bottom of hydrocyclone separator 50 and gravity discharged into cone bottom hopper 51. The remaining slurry mixture, comprised of the oil and water, in line 52, is gravity discharged into centrate collection tank 53. The solids settle to the bottom of the centrate collection tank 53. The oil and water are removed from the top at point 54 of the centrate collection tank. Jet transfer pump 55 located at base 56 of centrate collection tank 54 removes and mixes the solids with the hot water stream in line 57 and passes it through line 58 to a second hydrocyclone separator 59. Centrifugal forces within the second hydrocyclone separator 59 separate the remaining portion of the solids from the oil and water mixture. The solids are removed from the bottom of hydrocyclone separator 59 and gravity discharged into the cone bottom hopper 51. Optionally, the hot water wash step can be repeated multiple times with each step identical to the preceding step. As a further option, the solids collected from cone bottom hopper 51, mostly clays and silts, can be further treated by further thickening then fed into a thermal screw. There, the solids may be mixed with calcium oxide. The use of calcium oxide is contemplated in an embodiment of the invention to chemically condition the solids. Calcium oxide addition is to coagulate the solids to release sorbed water, which if added in sufficient concentration will locally increase the temperature of the solids, coupled with the heat input form the other direct and indirect heating systems can cause the water and any residual hydrocarbons to vaporize. The thermal screw may be equipped with a vapour recovery system since the reaction would be exothermic. A dry solids stream is produced after the oxidation of any remaining hydrocarbons in the clay and silt slurry.

Solids that are deposited in the cone bottom hopper 51 are removed via jet pump 60 at the base 61 and mixed with hot water stream in line 62 and passes it through line 63 the inlet of centrifuge 64 preferably using a basket or solid bowel centrifuge. Other alternative mechanical dewatering technology can be used such as inclined dewatering screws and/or belt filter presses. De-watered solids 65 can be optionally discharged into receiving pile 66 or alternatively discharged into cone bottom receiving hopper 67 for thermal treatment. Solids requiring additional thermal treatment for treatment and recovery of any residual hydrocarbons or alternatively for further drying are to be blended and mixed with calcium oxide in a controlled manner directly within the thermal screw at the inlet point of the thermal screw. Mixing calcium oxide with moist solids chemically reacts with the moisture associated with the solids to locally increase the temperature of solids through direct heating caused by the exothermic reactions, causing both moisture and residual hydrocarbons to vaporize. The mix ratio of calcium oxide is a function of the desired temperature increase, which to achieve can require the addition of water to the solids in hopper 67. Residual de-watered solids, consisting of the clays and silts recovered from the wastewater treatment process can be discharged via line 68 into the cone bottom receiving hopper 67 for thermal treatment.

Figure 1D:
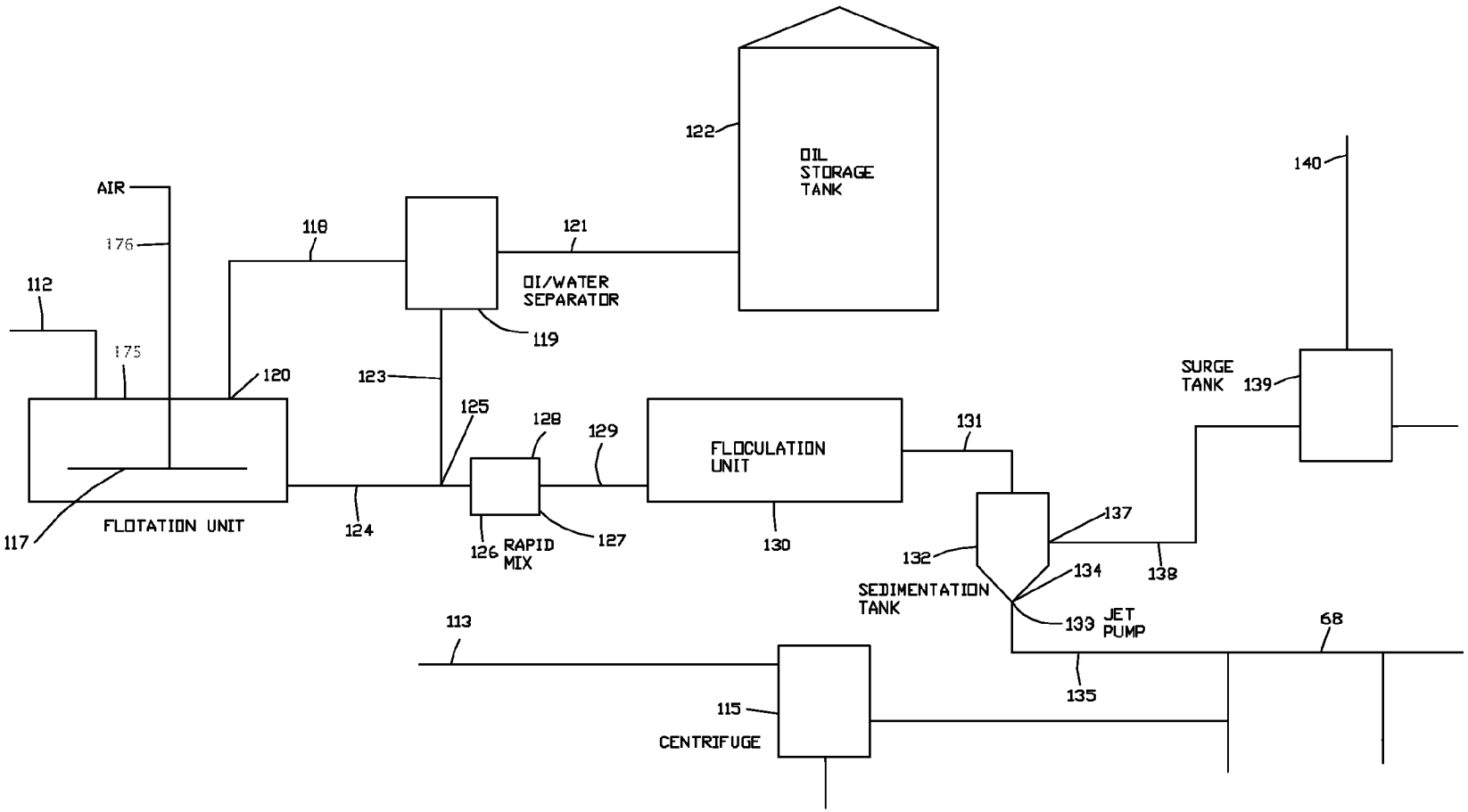
Figure 1E:
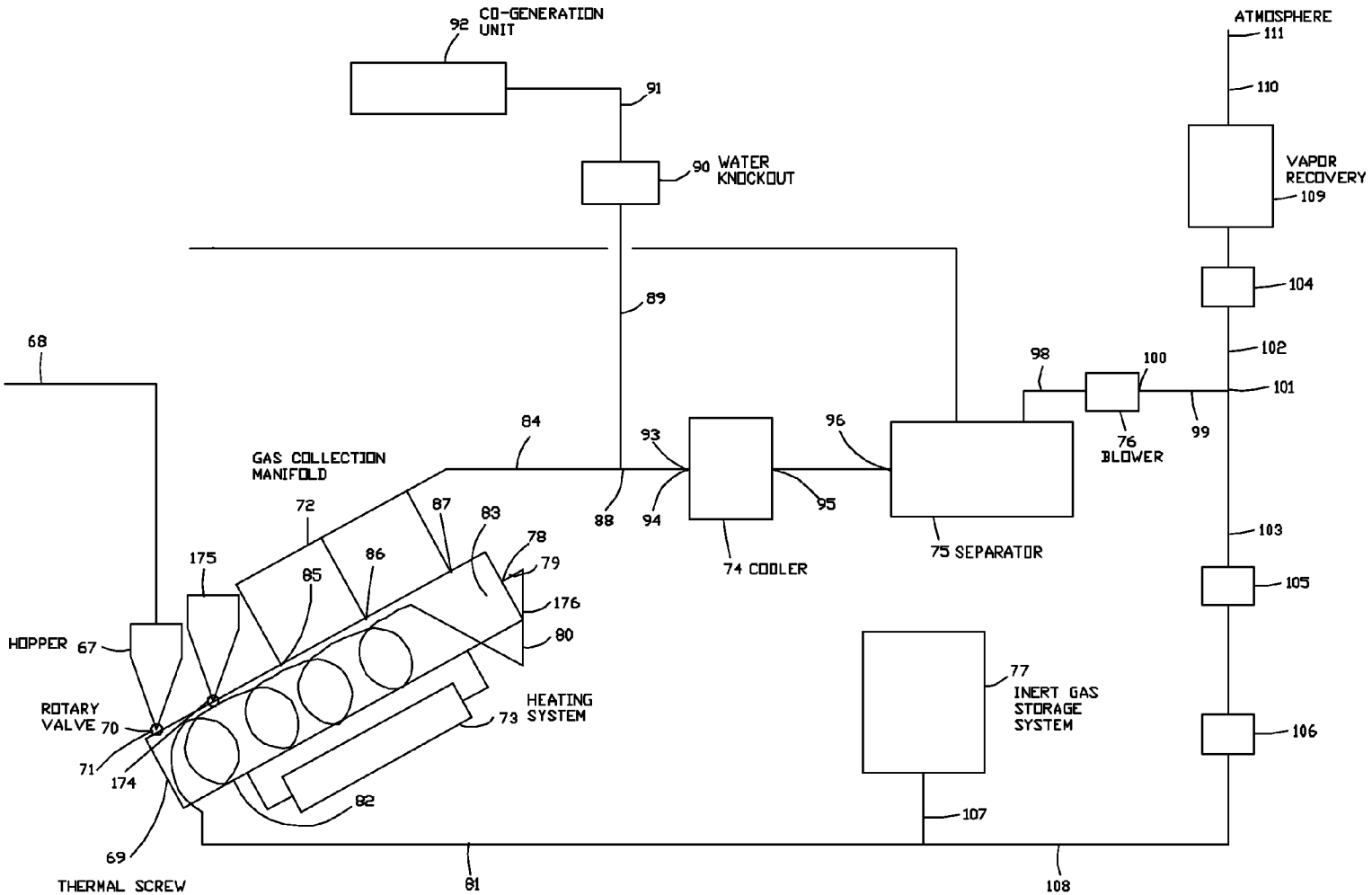

Referring in particular to FIG. 1E, subsequently, and optionally, a thermal screw 69 may be used to treat a portion of the entire solids fraction for removal of any residual hydrocarbons or alternatively for further drying. The thermal screw 69 is configured to contemplate the direct and indirect heating of the solids for treatment by exposing the solids directly to direct heat produced through the addition of calcium oxide and through the addition of either hot exhaust gases from a combustion engine or alternatively a hot inert gas. Calcium oxide is to be metered directly into the thermal screw at the inlet point for blending and mixing with the solids. Indirect heating is provided by the heater system 73 which can consist of the heating of the outside trough surface of the thermal screw using electric heaters, or an outside jacket designed to receive and circulate hot oil or alternatively steam for contact with the surface. A rotary valve 70 at the base of cone 71 of the receiving hopper 67 meters the de-watered solids into the thermal screw 69. A rotary valve (not shown) at the base of cone 174 meters calcium oxide into the solids fraction as it enters the thermal screw 67. Both rotary valves are equipped with a variable frequency drive to provide operational control of the feed input. The thermal screw 69 preferably consists of a screw conveyor complete with a gas manifold collection system 72, heating system 73, cooler 74, gas-liquid separator 75, blower 76, inert gas storage system 77, and inert gas recycle system at point 78. The de-watered solids are introduced into the thermal screw at point 69. Hot inert gas from the inert gas recycle system 78 or alternatively the hot exhaust gases from a combustion engine (not shown) is introduced into the thermal screw using a rotary swivel at 79 via line 80. Prior to introduction into the thermal screw 69 the inert gas is indirectly heated to the operating temperature of the thermal screw through the wrapping of the inert gas line 81 between the heater system 73 and body of the thermal screw 82. In the case where hot exhaust gases are used, the gases can be injected directly into the thermal screw without indirect preheating of the gases. Hot gases 83 from within the thermal screw 69 consisting principally of vaporized hydrocarbons and water vapor are removed under a vacuum in the case where an inert gas storage supply is used or alternatively under positive pressure in the case where hot exhaust gases from a combustion engine are used for direct heating and the maintaining of a non-oxidizing environment within the thermal screw from the thermal screw via line 84 at multiple gas discharge ports on top of the screw housing shown at the respective locations 85, 86 and 87.

The hot gases removed from the thermal screw via line 84 are separated into two gas streams at point 88. Hot gases in line 89 are passed into the water knockout drum 90 for water removal after which the gases pass through line 91 to the fuel inlet system of the gas fired co-generation unit 92.

Hot gases in line 93 are passed into the cooler at point 94, where the hot gas mixture is cooled using an air cooler 74. Alternatively, a chiller may be used instead. Exiting via line 95 from the cooler 74 is a cooled multi-phase mixture consisting of the inert gas and liquid droplets of oil and water. The mixture enters the gas-liquid separator 75 at point 96 where the condensate is separated from the inert gas. The inert gas exits the gas-liquid separator 75 via line 98.

Blower 76 preferably a rotary lobe blower withdraws the hot gases from the thermal screw under a vacuum or positive pressure depending on the source and nature of the hot gases used for direct heating and maintenance of the non-oxidizing environment. The blower is equipped with a variable speed drive to control the vacuum pressure under which the thermal screw 69 is operated.

The inert gas is discharged from the blower 76 via line 99, where at point 101, the line is split into two gas streams shown via lines 102 and 103. Control valves 104 and 105 and gas flow meter 106 regulate the inert gas flow that is recycled to the thermal screw 69. Inert gas via line 107 and recycled gas 108 are indirectly heated using the hot outside surface of the thermal screw housing before entering the swivel connection at 78 of the holoflyte screw auger of the thermal screw. Excess exhaust gas, via line 102, enters a vapor recovery unit 109 where the gas is further chilled to remove any residual hydrocarbons and vaporized metals. The inert gas is discharged from the vapor recovery system via line 110 to the atmosphere at point 111. Optionally the entire inert gas stream via line 99 can be recycled via line 103 or alternatively discharged via line 102 to be processed by the vapor recovery unit 109 as would be the case for hot exhaust gases utilized from a combustion engine for direct heating.

Referring in particular to FIG. 1D, oily materials separated by hydrocyclone separators 10, 19, 31, 40, 50 and 59 and discharged into centrate collection tanks 13, 34 and 53 via lines 12, 33, and 52 are treated separately for the recovery of bitumen oil for the different oil-water mixtures via lines 112 and 114 and oil-solvent mixture streams via line 113. All, or a portion of all, the solids fraction de-watered using the centrifuges 115 and 116 are gravity discharged into the feed hoppers 45 and 67 of the thermal screw 69. The oil-water fraction of the oily material deposited in centrate collection tank 13 overflows via line 112 into a floatation unit 175. Air is introduced via a line 176 into the floatation unit 175 through fine bubble diffusers at 117 to produce fine bubbles to float and concentrate the bitumen oil to produce a froth which discharges via line 118 into the oil-water separator 119.

The concentrated oil-water mixture is removed at point 120 of the floatation unit 175 and passed via line 118 to the oil/water separator 119. The oil water separator 119 separates the oil from the water, with the oil removed via line 121 and passed into the oil storage tank 122. The water is removed via line 123 which then interconnects with line 124 to form line 125 which is passed into the rapid mix tank 126.

The water mixture enters the rapid mix tank 126 where it is treated with the primary coagulant 127 introduced via a line into the mix tank 128. Synthetic polymers are the preferred coagulant, but metal-based coagulants can also be used. The treated water mixture exits the rapid mix tank 126 via line 129 and enters into the flocculation unit 130. The treated water mixture flows through a series of baffled slow mix chambers equipped with slow rotating mechanical mixers. Residual particles in the water mixture are coagulated and agglomerated within the flocculation unit.

The coagulated water exists the flocculation unit 130 via line 131 and enters into the sedimentation tank 132. The coagulated solids are gravity settled in the sedimentation tank 132. The jet pump 133 at the base 134 of the sedimentation tank 132 removes and transfers the coagulated solids via line 135 to the mechanical de-watering unit 116, preferably a basket or solid bowel centrifuge. The de-watered solids exits the centrifuge via line 136 and are transferred to the cone bottom receiving hopper 67 of the thermal screw 69.

Figure 1F:
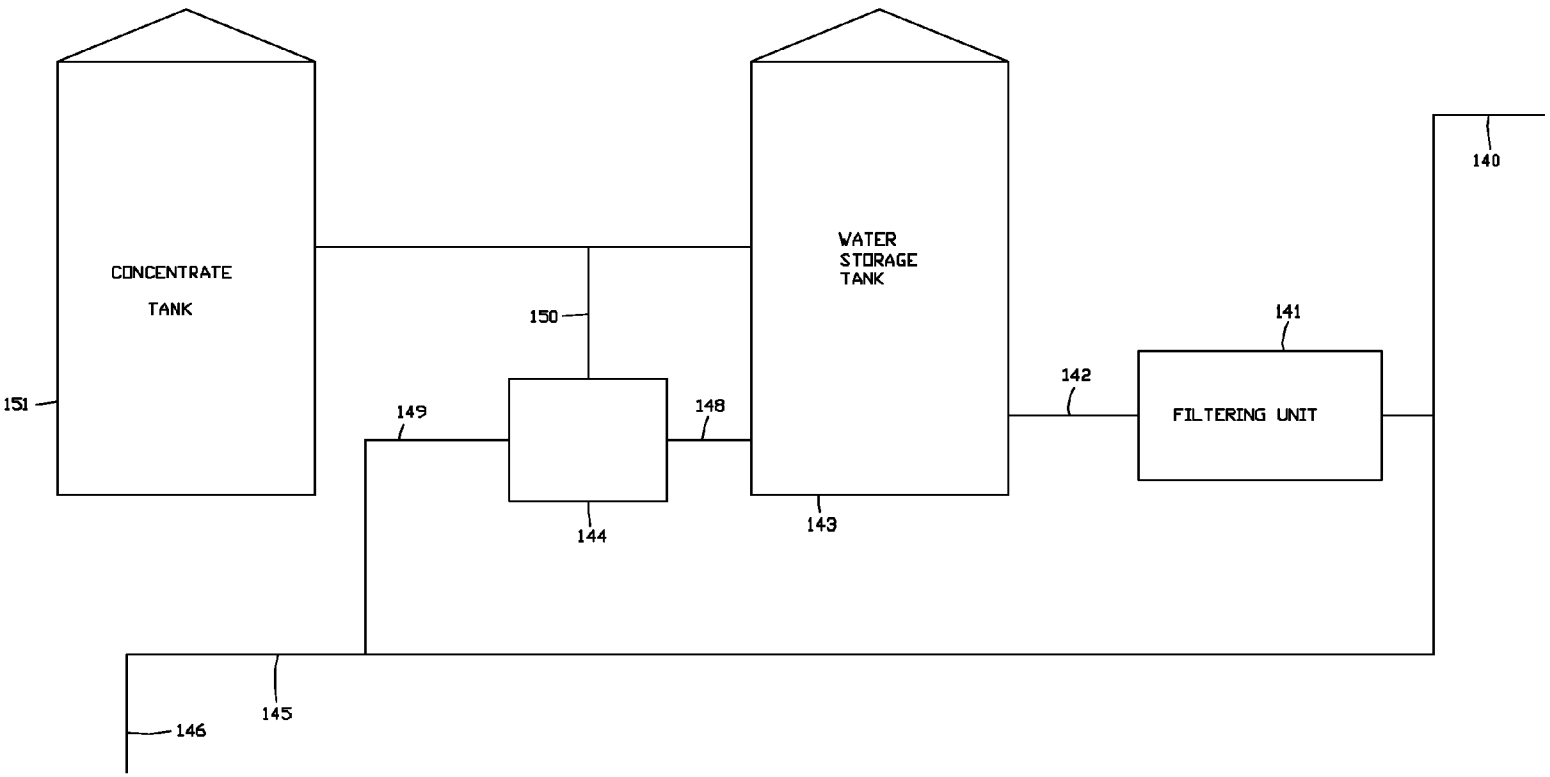
Figure 1G:
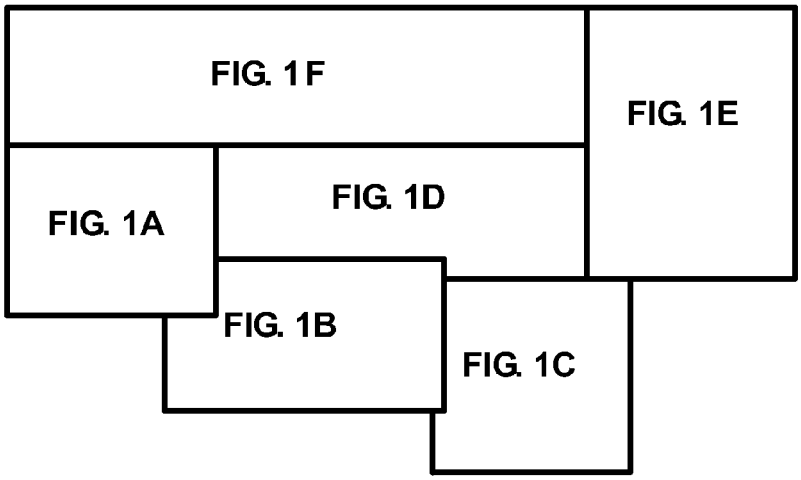

Referring in particular to FIG. 1F, the water from the sedimentation tank 132 overflows via a weir at point 137 and is discharged via line 138 to the surge tank 139. From surge tank 139 the water is pumped via line 140 into the filtration unit 141 for the removal of any residual solids carryover from the sedimentation tank 132. Residual solids are captured within filtration unit 141. The clarified water exits the filtration unit 141 via line 142 and enters the storage tank 143. From the storage tank water enters the vacuum filtration unit 144.

Optionally, the filter unit 141 and vacuum filtration unit 144 may be by-passed via line 145 with the clarified water directly recycled via line 146 to the water storage tank 147.

Clarified water via line 148 enters the vacuum filtration unit 144 where it is heated under a vacuum to produce distilled water. Distilled water exits via line 149 from the vacuum filtration unit 144 where it is pumped to the water storage tank 147. The brine concentrate containing the impurities is discharged from the vacuum filtration unit 144 via line 150 into the concentrate tank 151 for disposal. Optionally, the concentrate can be recycled back to the vacuum filtration unit using a control loop that relies on the resultant brine concentration for additional distillation to recover as much as distilled water as possible.

Figure 2:
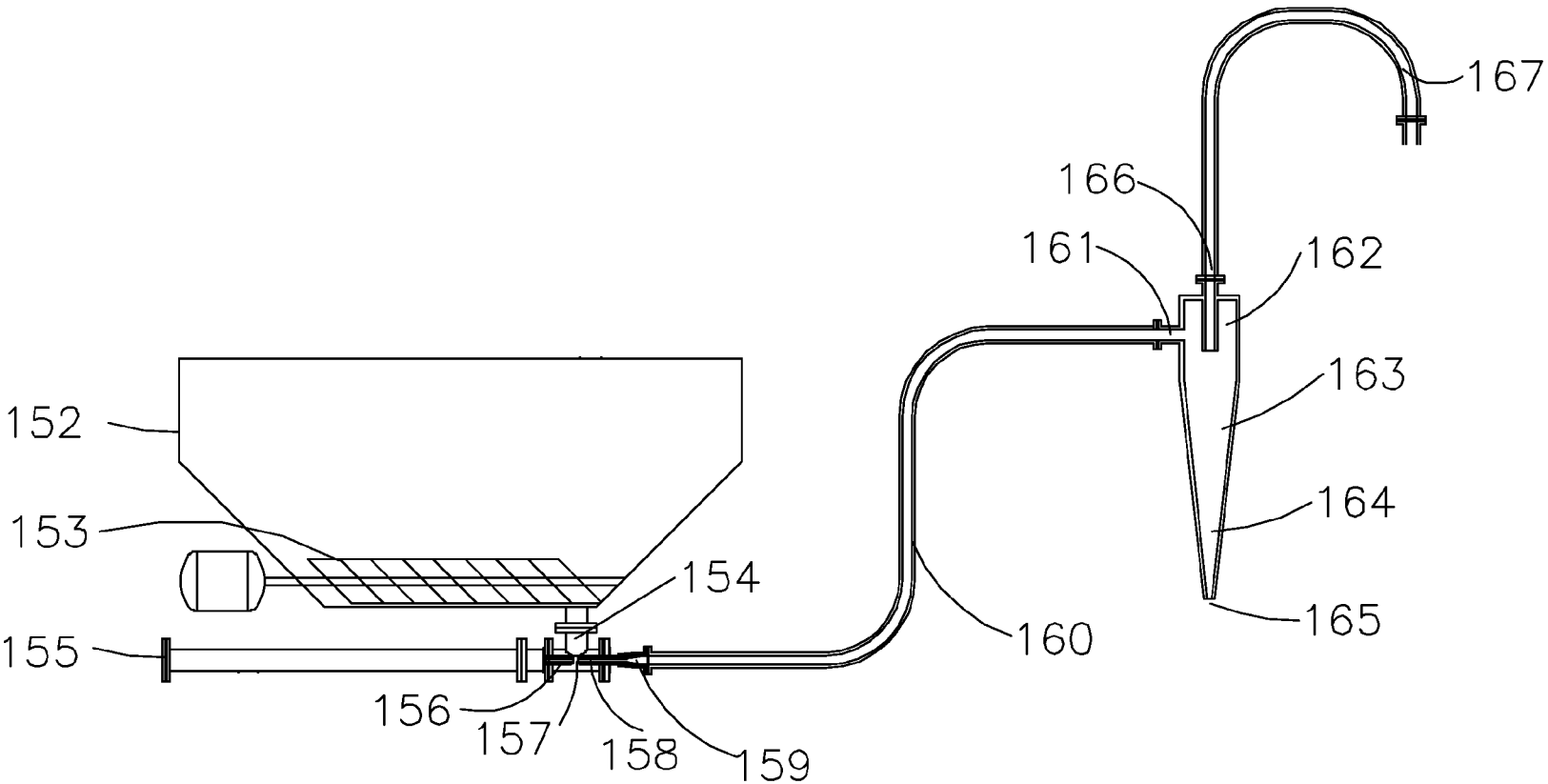

With reference to FIG. 2, the operation of a preferred feed hopper, jet pump and hydrocyclone is described in further detail. The tar sands material is first deposited into feed hopper 152 that has an elongated trough at its base within which lies an auger 153. The tar sands material is then augured with auger 153 to the inlet of the jet pump 154. A pressurized wash fluid 155 is fed to the inlet nozzle 156 of the jet pump 154 using a conventional centrifugal pump (not shown). The jet pump inlet nozzle 156 directs a flow into the mixer 157 educting the tar sands into the jet pump 154 where extreme turbulence and mixing occurs at point 158. The slurry flow slows in velocity in the diffuser 159. The slurry then flows into an engineered pipeline 160 of a sufficient length required to optimize separation for the wash fluid used from where it enters the entrance of the hydrocyclone 161. A centrifugal force is created in the upper chamber 162 of the hydrocyclone. The solids are forced to the outside of the hydrocyclone at point 163 and the wash fluid and bitumen are forced to the center of the hydrocyclone at point 164. The solids exit the hydrocyclone at the vortex 165 as an underflow. The wash fluid and bitumen exit the hydrocyclone as an overflow at point 166 at the top of the hydrocyclone. The wash fluid and bitumen are transported in a flexible pipeline 167 to the next phase which can be a repeat of the first step.

Figure 3:
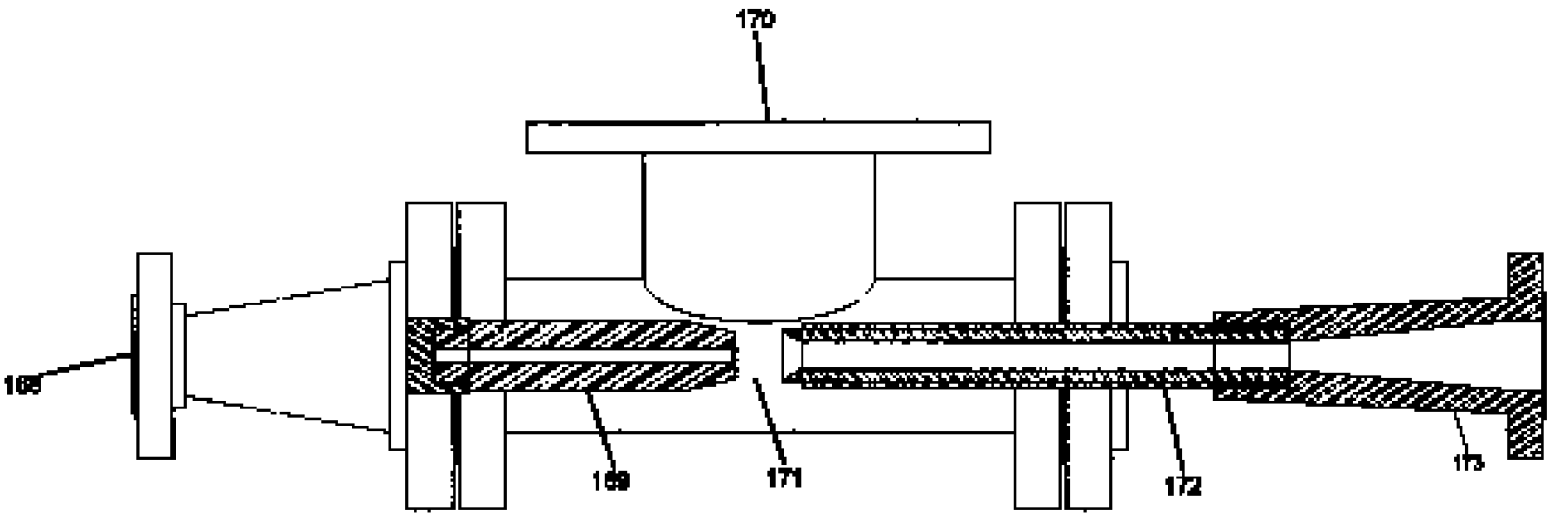
FIG. 3 is a detailed schematic of a jet pump for use in a method according to the invention.

With reference to FIG. 3, the operation of the jet pump 154 (FIG. 2) is described in further detail. Unlike other pumps, a jet pump has no moving parts. A typical jet pump consists of the following: a jet supply line 168, a nozzle 169, a suction chamber 171, a mixing chamber 172 and a diffusor 173 leading to a discharge line. In a jet pump, pumping action is created as a fluid (liquid, steam or gas) passes at a high pressure and velocity through the nozzle 169 and into a chamber 171 that has both an inlet and outlet opening. Pressurised wash fluid is fed into the jet pump 154 (FIG. 2) at jet supply line 168. The wash fluid passes through inlet nozzle 169, where it meets tar sand material gravity fed from hopper inlet 170 at the suction chamber 171. The resulting slurry is mixed and agitated within the mixing chamber 172 where it undergoes an initial phase separation of oil fraction from solid fraction. The agitated slurry slows in velocity in the diffuser 173. Upon entry into the jet pump 154 (FIG. 2), the tar sands material from hopper 152 is entrained and mixed with the wash fluid from the nozzle 169, which undergoes a substantial pressure drop across the jet pump 154 (FIG. 2) and causes extreme mixing of the slurry. The extreme mixing and pressure drop causes cavitation bubbles to develop on the inside of chamber 171, which implode on solid particles to enhance the separation of the bitumen oil from the solid particles.

The jet pump of the present invention functions as an ejector or an injector or an eductor, distinct from a venturi pump and an airmover. A venturi has little in common conceptually with a jet pump. A venturi is a pipe that starts wide and smoothly contracts in a short distance to a throat and then gradually expands again. It is used to provide a low pressure. If the low pressure is used to induce a secondary flow it becomes a pump, resulting in a loss of pressure in the throat. If the secondary flow is substantial the loss will be too great to have a venturi operate like a pump. To operate like a pump it would have to be redesigned as a jet pump. Venturi pumps have limited capacity in applications like chemical dosing where a small amount of chemical is added to a large volume of fluid. A jet pump is a pump that is used to increase the pressure or the speed of a fluid. Energy is put into the fluid and then taken out by a different form. In a jet pump energy is added by way of a high speed jet fluid called the primary flow. In the design shown in FIG. 3, the primary flow is produced by jet nozzle 169. Energy is taken out mostly as increased pressure of a stream of fluid passing through. In a jet pump this stream is called the secondary flow and it is said to be entrained by the primary flow. A jet pump is designed to be energy efficient. A venturi pump does not have the capacity to induce large volumes of flow, where as a jet pump can and operate energy efficient. Unlike a venturi pump, a jet pump consists of a nozzle, mixing chamber and diffuser. In a jet pump these components are specifically engineered to have the pump operate energy efficient. A venturi pump does not have a defined nozzle, but instead a constriction in the pipe. It also does not have a defined mixing chamber.

The wash fluid can be combination of fluids used singularly or in combination in multiple loops consisting of a chemically treated or chemical free hot or cold water or alternatively a hot or cold solvent. The wash fluid can chemically and/or physically react with the bitumen oil to partition the oil to the liquid phase to permit separation and recovery by hydrocyclone separation. The continuous supply of wash fluid by the motive pump provides for the transport of the tar sands carried in a wash fluid stream to continue the extraction of bitumen from the oil sands in the pipeline. Hydrocyclone separator 161 is used to classify and remove the bitumen oil and water fraction from the solids fraction, with the solid fraction deposited into a second hopper. If necessary, the solids fraction can be repeatedly treated for additional bitumen recovery by repeating the process.

PROCESS CONDITIONS

As the tar sands enter the receiving feed hopper, they are mechanically ground, preferably using a horizontal shear mixer, to reduce the solid particles to 25 mm in size or smaller. The motive pump (not shown), preferably of a centrifugal pump, is configured to draw chemical free hot water of a temperature at about 95 degrees Celsius from a hot water tank to produce a high pressure water stream at the inlet of the jet pump. At the jet pump inlet the high pressure water stream, at approximately 120 psi, is converted within the jet pump nozzle into a high velocity water jet, referred to as the primary flow. The substantial pressure drop within the jet pump draws the slurry mixture from the hopper, referred to as the secondary flow, into the jet pump where it is mixed with the primary flow to achieve a resultant percent solids concentration of 25% or less by volume.

The optional treatment of the clays and fines, collected after the solids are collected from the first wash process, would be thickened to approximately 60% solids before being fed into the thermal screw.

This invention therefore contemplates the use of jet pumps to effect separation of oil from solid particles. This method distinguishes itself from other processes in that it does not contemplate the use of elutriation vessels, clarifiers, separators, baths or the like to condition and or separate the oil and liquids from the solids fraction. Bitumen separation is achieved during mixing within the jet pump and pipeline during transport. No other vessels or technologies are required to effect separation of bitumen oil from solids. Therefore the process is substantially simplified in comparison to existing hot water or solvent bitumen extraction processes. The use of centrifugal forces by way of hydrocyclones and centrifuges are employed throughout the process for separation and classification of the different stream fractions consisting of water, oil, and solids. In accordance with aspects of this invention, physical, chemical and thermal processes are employed to separate, treat and recover bitumen oil from solid particles, irrespective of the oil and solid type and concentration. Direct and indirect heating of the different medias are provided using a variety of chemical and chemical free treatment liquid wash and thermal processes to effect separation of bitumen oil from the solids. Such process strategy provides for the treatment of all solid particle types, including those particles of high surface activity consisting of silts and clays, prone to adsorb and retain oil contamination. Treatment and disposal of the fines are provided in the process contemplated, maximizing the recovery of bitumen.

There are no moving parts contacting the slurry, making this process less mechanically intensive and subsequently more economical to operate from a O&M standpoint, compared to other bitumen recovery processes. Each step of the method is configured and optimized to separate bitumen with the end process being bitumen recovery.

The method has application in the processing of tar sands, production sand, drill cuttings derived from bitumen laden geological formations using water based drill fluids, contaminated oily sand or gravel, and contaminated soil.

Immaterial modifications may be made to the embodiments disclosed here without departing from the invention.

What is claimed is:

1. A process for phase separation of a slurry containing a mixture of a solids fraction and an oil and water fraction, the process comprising the steps of:

depositing the slurry into a receiving hopper at an input point of a separation process, the receiving hopper having an outlet, wherein the receiving hopper is free of phase separation devices;

supplying the slurry from the outlet of the receiving hopper into a mixing chamber of a jet pump at the input point of the separation process, the jet pump being supplied with wash fluid from a power source, wherein the jet pump operates at a Reynolds number above 250,000;

agitating the slurry within the mixing chamber of the jet pump to effect an initial partial to full phase separation of the oil and water fraction from the solids fraction of the slurry;

discharging the partially to fully separated oil and water fraction and solids fraction of the slurry from the jet pump into a pipeline for continued separation through mixing and contact with the wash fluid within the pipeline; and discharging the partially to fully separated mixture of the oil and water fraction and the solids fraction of the slurry from the pipeline into a phase separation device to effect a second phase separation of the slurry and produce a first output stream comprising the solids fraction and a second output stream comprising the oil and water fraction.

2. The process of claim 1 in which the slurry comprises unprocessed tar sand from a mining or drilling operation.

3. The process of claim 1 further comprising repeating the process steps of claim 1 to yield a solids fraction and chemically conditioning the solids fraction with calcium oxide.

4. The process of claim 1 further comprising treating all or portions of the first output stream with a thermal screw to produce a solids fraction free of any residual water and hydrocarbons.

5. The process of claim 1 in which the phase separation process uses a hydrocyclone.

6. The process of claim 1 in which the slurry comprises tailings from a mining or drilling operation.

* * * * *

UNITED STATES PATENT AND TRADEMARK OFFICE

CERTIFICATE OF CORRECTION

PATENT NO. : 7,416,671 B2
APPLICATION NO. : 10/895364
DATED : August 26, 2008
INVENTOR(S) : W. R. Bozak et al.

It is certified that error appears in the above-identified patent and that said Letters Patent is hereby corrected as shown below:

| COLUMN | LINE | |
|---|---|---|
| 10 | 31 | "device" should read --process-- |

Signed and Sealed this

Thirtieth Day of June, 2009

JOHN DOLL
*Acting Director of the United States Patent and Trademark Office*